US006116725A

United States Patent [19]

Kato et al.

[11] Patent Number: 6,116,725

[45] Date of Patent: Sep. 12, 2000

[54] INK CARTRIDGE USED IN INKJET PRINTER

[75] Inventors: Hitoshi Kato, Itami; Takeshi Yamashita, Kawanishi, both of Japan

[73] Assignee: Minolta Co., Ltd., Osaka, Japan

[21] Appl. No.: 09/056,270

[22] Filed: Apr. 7, 1998

[30] Foreign Application Priority Data

Apr. 11, 1997 [JP] Japan ..... 9-092669

[51] Int. Cl.[7] ..... B41J 2/175

[52] U.S. Cl. ..... 347/86

[58] Field of Search ..... 347/85, 86, 87

[56] References Cited

U.S. PATENT DOCUMENTS 5,156,472 10/1992 Suzuki et al. ..... 400/124
5,790,158 8/1998 Shinada et al. ..... 347/86

FOREIGN PATENT DOCUMENTS 7-52404 2/1995 Japan .
7-68785 3/1995 Japan .

*Primary Examiner*—N. Le
*Assistant Examiner*—Michael Nghiem
*Attorney, Agent, or Firm*—Sidley & Austin

[57] ABSTRACT

An ink cartridge has an ink holding chamber, an ink holding member that is placed inside the ink holding chamber and that holds ink, an ink supply outlet that connects the ink holding chamber and the outside; and a protruding member that is placed on the wall of the ink holding chamber in which the ink supply outlet is formed and that protrudes into the ink holding chamber. In the ink cartridge, the protruding member that protrudes into the cartridge presses onto the ink holding member from the area around the ink supply outlet. Consequently, the ink holding member becomes compressed by means of the protruding member, so that the ink held in the ink holding member flows out easily from the ink holding member. Further, in the ink cartridge, it is preferred that the protruding member be located such that it surrounds the supply outlet and that an ink pathway where the protruding member does not exist be created in at least part of the area around the ink supply outlet. This construction permits the ink to be sent smoothly to the ink supply outlet via the ink pathway. When the ink is sent smoothly to the ink supply outlet in this way, even shortly after the ink is supplied to the ink holding member or when a large amount of ink is supplied to the print head via the ink supply outlet for the purpose of continuous printing or purging, a sufficient amount of ink is stably led to the print head via the ink supply outlet.

13 Claims, 4 Drawing Sheets

FIG. 5
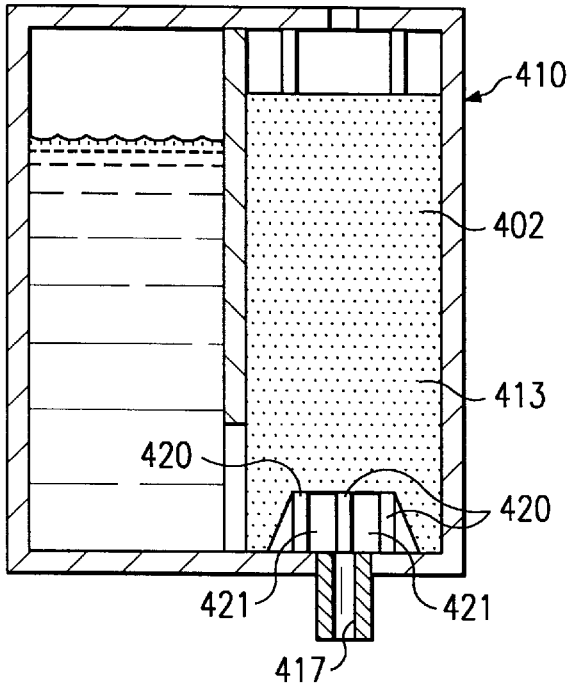
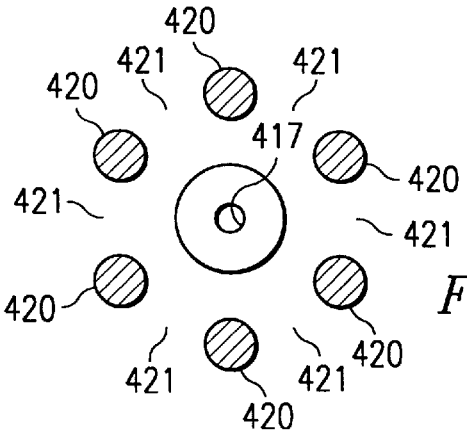
FIG. 6
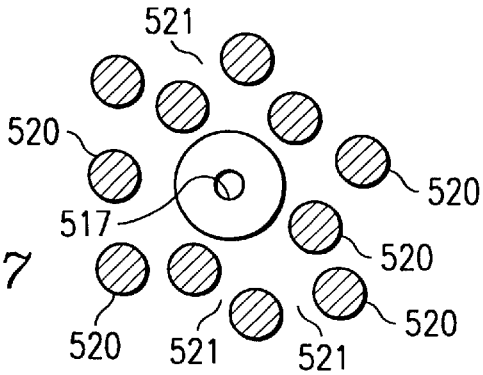
FIG. 7

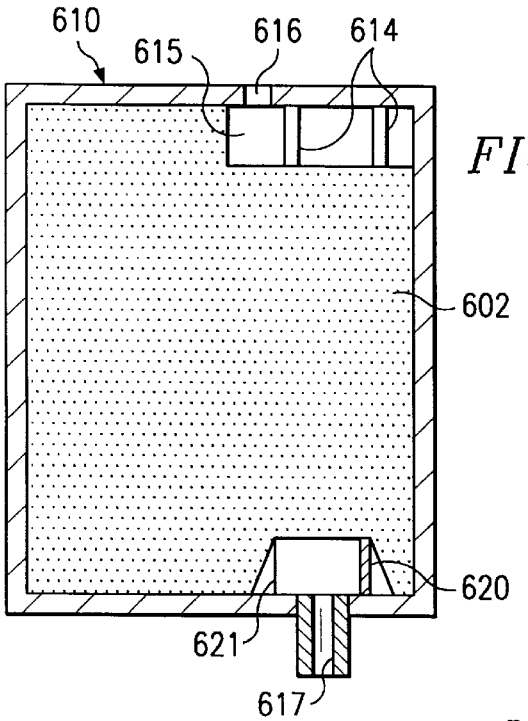
FIG. 8
FIG. 9
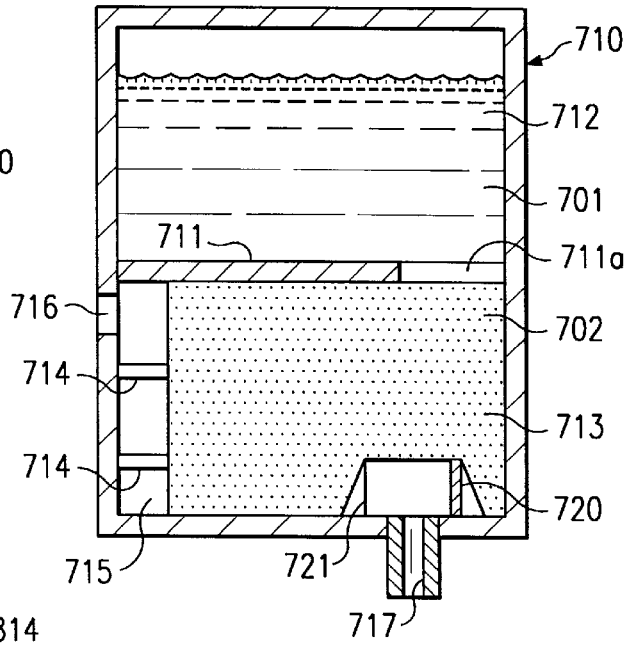
FIG. 10
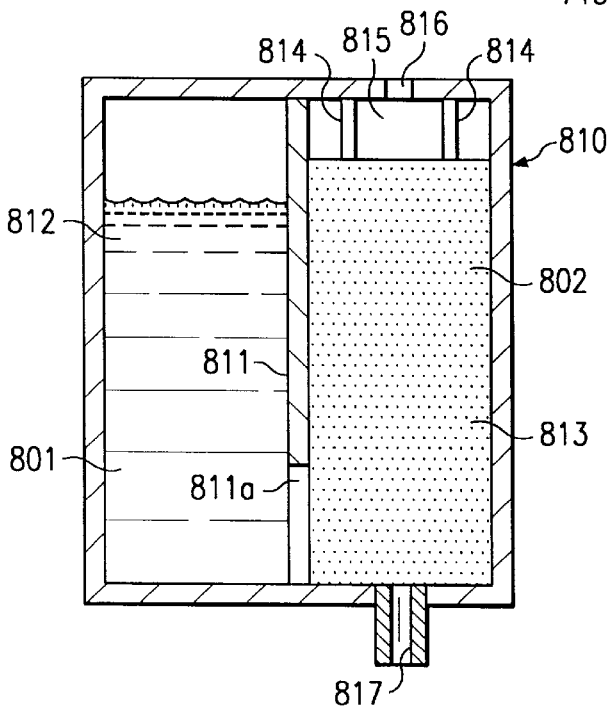

INK CARTRIDGE USED IN INKJET PRINTER

This application is based on application No. 9-92669 filed in Japan, the contents of which are hereby incorporated by reference.

BACKGROUND OF THE INVENTION

1. Field of the Invention

The present invention pertains to an ink cartridge that houses ink to be supplied to the print head in an inkjet printer, and more particularly, to an ink cartridge within which is an ink holding member that holds the ink such that the ink held in this ink holding member may be supplied to the print head via the ink supply outlet of the cartridge.

2. Description of the Related Art

Conventionally, when an inkjet printer performs printing through the expulsion of ink from the print head, the ink housed in the ink cartridge is generally supplied to the print head via the ink supply outlet that is located on the ink cartridge.

Various types of ink cartridges using this principle have conventionally been available. For example, a box-type ink cartridge made of such a material as synthetic resin is available, said ink cartridge having a construction in which (i) an ink holding member comprising a sponge, for example, that holds the ink is placed inside the ink cartridge, and (ii) an ink supply outlet to supply the ink held in the ink holding member to the print head is formed at the bottom of the ink cartridge such that the ink held in the ink holding member may be supplied to the print head via this ink supply outlet.

These ink cartridges have the problem, however, that shortly after ink is supplied to the ink holding member, or when a large amount of ink is supplied to the print head via the ink supply outlet, the ink is not smoothly supplied to the print head via the ink supply outlet and air is instead supplied to the print head via the ink supply outlet, clogging the print head and causing a problem with printing. The case referred to above, where a large number of ink is supplied to the print head via the ink supply outlet, occurs when continuous printing is performed or when a purge operation is performed.

OBJECTS AND SUMMARY

In consideration of the problem described above, the object of the present invention is to provide an improved ink cartridge that is used in an inkjet printer to supply ink to the print head.

Another object of the present invention is to provide an ink cartridge that smoothly supplies ink through the ink supply outlet.

Yet another object of the present invention is to provide an ink cartridge that permits a sufficient amount of ink to be supplied to the print head via the ink supply outlet in a stable fashion even shortly after the ink is supplied to the ink holding member or when a large amount of ink is supplied to the print head via the ink supply outlet for the purpose of continuous printing or purging.

In order to attain these objects, the ink cartridges of the present embodiment comprise an ink holding chamber, an ink holding member that is placed inside the ink holding chamber and that holds ink, an ink supply outlet that connects the ink holding chamber and the outside; and a protruding member that is placed on the wall of the ink holding chamber in which the ink supply outlet is formed and that protrudes into the ink holding chamber, wherein the protruding member presses onto the ink holding member so that a space is created between said supply outlet and the ink holding member.

In said ink cartridge, the protruding member that protrudes into the cartridge presses onto the ink holding member from the area around the ink supply outlet. Consequently, the ink holding member becomes compressed by means of the protruding member, so that the ink held in the ink holding member flows out easily from the ink holding member.

Further, in said ink cartridge, it is preferred that the protruding member be located such that it surrounds the supply outlet and that an ink pathway where the protruding member does not exist be created in at least part of the area around the ink supply outlet.

This construction permits the ink to be sent smoothly to the ink supply outlet via the ink pathway. When the ink is sent smoothly to the ink supply outlet in this way, even shortly after the ink is supplied to the ink holding member or when a large amount of ink is supplied to the print head via the ink supply outlet for the purpose of continuous printing or purging, a sufficient amount of ink is stably led to the print head via the ink supply outlet.

BRIEF DESCRIPTION OF THE DRAWINGS

These and other objects and features of the present invention will become apparent from the following description of preferred embodiments thereof taken in conjunction with the accompanying drawings, in which:

FIG. 5 is a cross-section of an ink cartridge of a fourth embodiment.

FIG. 6 is a drawing showing the manner in which the protruding member is placed around the ink supply outlet in the ink cartridge of the fourth embodiment.

FIG. 7 is a drawing showing the manner in which the protruding member is placed around the ink supply outlet in an ink cartridge of a fifth embodiment.

FIG. 8 is a cross-section of an ink cartridge of a sixth embodiment.

FIG. 9 is a cross-section of an ink cartridge of a seventh embodiment.

FIG. 10 is a cross-section of an ink cartridge of a first comparison model.

In the following description, like parts are designated by like reference numbers throughout the several drawings.

DETAILED DESCRIPTION OF THE PREFERRED EMBODIMENTS

The ink cartridges pertaining to the embodiments of the present invention are specifically explained below with reference to the drawings, and the fact that the ink is sufficiently supplied via the ink supply outlet when an ink cartridge of any of said embodiments is used is made clear using the comparison models.

First Embodiment

Figure 1:
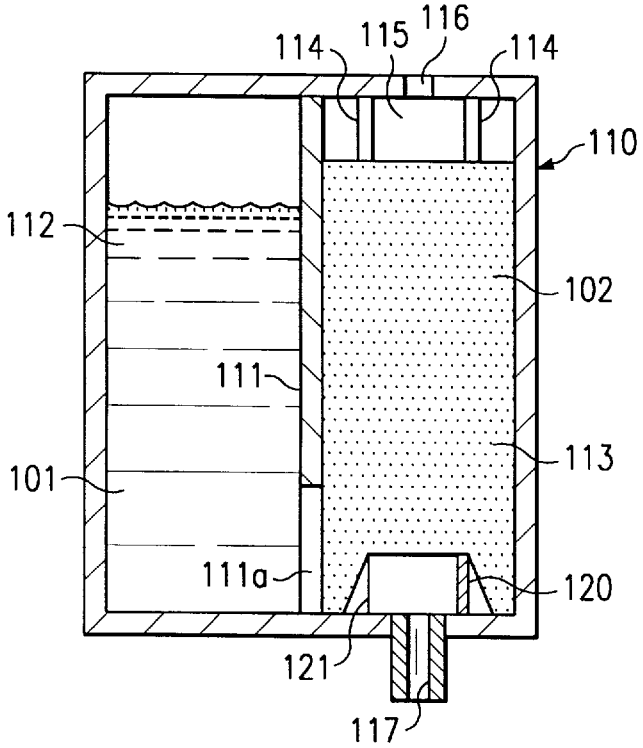
FIG. 1 is a cross-section of an ink cartridge of a first embodiment.

Ink cartridge 110 pertaining to the first embodiment is made of translucent ABS resin and has a box configuration with a height of 50 mm, a width of 40 mm and a depth of 15 mm, as shown in FIG. 1. Partition 111 that extends vertically is placed inside this ink cartridge 110. This partition 111 divides the interior of cartridge 110 into (i) ink storage chamber 112 in which ink 101 is stored, and (2) ink holding chamber 113 in which ink holding member 102 that holds ink 101 is housed. At the bottom of partition 111 is created ink path opening 111*a* that links ink storage chamber 112 and ink holding chamber 113.

Ribs 114 are placed in the upper area of ink holding chamber 113 described above. These ribs 114 position ink holding member 120 inside ink holding chamber 113 and form air chamber 115 in the upper area of ink holding chamber 113. Air inlet 116, to introduce air into cartridge 110, is formed in the top wall of this air chamber 115.

Further, at the bottom of this ink holding chamber 113 is placed a cylindrical ink supply outlet 117 having a 1.0 mm inner diameter such that it protrudes outside cartridge 110. Protruding member 120 is placed around this ink supply outlet 117, and inside ink holding chamber 113, so that the protruding member protruding inside cartridge 110 pushes up ink holding member 102.

Figure 2:
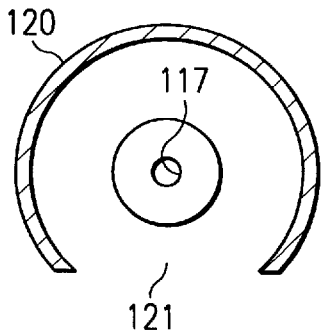
FIG. 2 is a drawing showing the manner in which the protruding member is placed around the ink supply outlet in the ink cartridge of the first embodiment.

FIG. 2 is a plan view showing this protruding member 120 from above. Protruding member 120 comprises a cylinder having a 6.0 mm inner diameter and a height of 2.0 mm, a part of which is cut away such that the opening will measure 5.0 mm in width. Protruding member 120 is placed around ink supply outlet 117 such that opening 121 faces ink path opening 111*a*. Consequently, opening 121 functions as an ink pathway so that the ink is smoothly supplied to ink supply outlet 117.

Ink 101 is a water-soluble ink having a viscosity of 2 cp and a surface tension of 30 dyn/cm. For ink holding member 102, a polyurethane sponge having a density of 0.05 g/cc and pores of a 0.2 mm average diameter is used. It is housed inside ink holding chamber 113 while being compressed such that its density will become approximately 1.5 times that of the original density.

Second Embodiment

Figure 3:
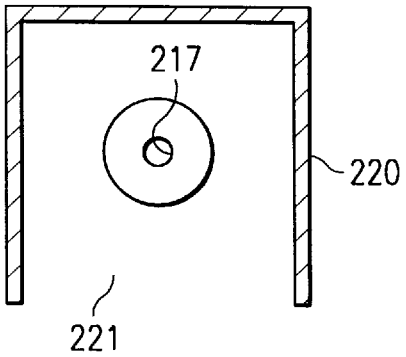
FIG. 3 is a drawing showing the manner in which the protruding member is placed around the ink supply outlet in an ink cartridge of a second embodiment.

The ink cartridge pertaining to the second embodiment differs from ink cartridge 110 of the first embodiment only with regard to the configuration of the protruding member, and all other components of the construction are the same. Therefore, the second embodiment will be explained with reference to FIG. 3, which shows a plan view of protruding member 220 from above, and explanation of other components will be omitted.

Protruding member 220 has the configuration of a U with three sides. The length of a side is 5.0 mm and its height is 2.0 mm. This protruding member 220 is placed around ink supply outlet 217 such that opening 221 will face the ink path opening, so that an ink pathway leading to ink supply outlet 217 is formed. Protruding member 220 pushes up the ink holding member in the same manner as protrusion member 120 of the first embodiment, and creates a space between ink supply outlet 217 and the ink holding member.

Third Embodiment

Figure 4:
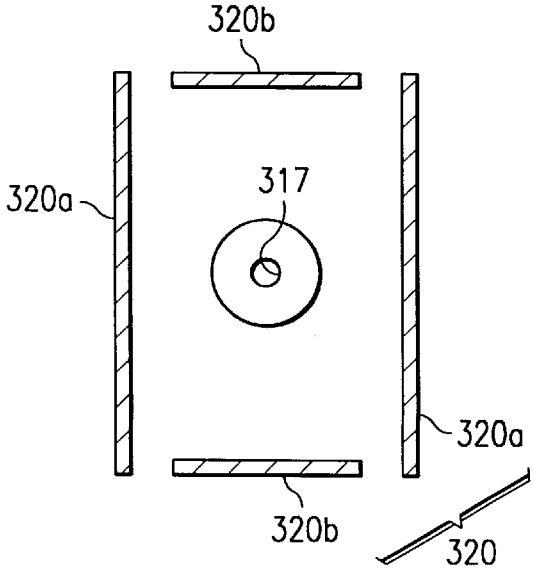
FIG. 4 is a drawing showing the manner in which the protruding member is placed around the ink supply outlet in an ink cartridge of a third embodiment.

The ink cartridge of the third embodiment differs from the ink cartridge of the first embodiment only with regard to the configuration of the protruding member, and all other components of the construction are the same. Therefore, the third embodiment will be explained with reference to FIG. 4, which shows a plan view of protruding member 320 from above, and explanation of other components will be omitted.

Protruding member 320 comprises two long plates 320*a* having a height of 2.0 mm and a width of 7.0 mm, and two short plates 320*b* having a height of 2.0 mm and a width of 4.0 mm. The two long plates 320*a* and two short plates 320*b* are located such that they surround ink supply outlet 317 on four sides and protrude from the bottom of the ink holding chamber. A 0.5 mm gap is left between adjacent plates, and the gaps comprise ink pathways leading to ink supply outlet 317. Protruding member 320 pushes up the ink holding member in the same manner as protruding member 120 of the first embodiment, and creates a space between ink supply outlet 317 and the ink holding member.

Fourth Embodiment

Ink cartridge 410 of the fourth embodiment differs from ink cartridge 110 of the first embodiment only with regard to the configuration of the protruding member, and all other components of the construction are the same.

As shown in FIGS. 5 and 6, the protruding member comprises six cylindrical protrusions 420 having a 1.0 mm diameter and a height of 2.0 mm. The six protrusions 420 are placed around ink supply outlet 417 at equal intervals such that they protrude from the bottom of ink holding chamber 413. Gaps 421 between adjacent protrusions 420 comprise ink pathways leading to ink supply outlet 417. The six protrusions 420 push up ink holding member 402 in the same manner as protruding member 120 of the first embodiment to create a space between ink supply outlet 417 and ink holding member 413. Therefore, the six protrusions 420 together play the role of protruding member 120 of the first embodiment.

Fifth Embodiment

The ink cartridge of the fifth embodiment differs from the ink cartridge of the fourth embodiment only with regard to the number and locations of the protrusions, and all other components of the construction are the same.

As shown in FIG. 7, eleven cylindrical protrusions 520 having a diameter of 1.0 mm and a height of 2.0 mm, which are identical to those used in the fourth embodiment, are used in the fifth embodiment. These protrusions 520 are placed randomly around ink supply outlet 517 such that they protrude from the bottom of the ink holding chamber. Gaps 521 between these eleven protrusions comprise ink pathways leading to ink supply outlet 517, and push up the ink holding member in the same manner as protruding member 120 of the first embodiment to create a space between ink supply outlet 517 and the ink holding member. Therefore, the eleven protrusions 520 play the role of protruding member 120 of the first embodiment.

Sixth Embodiment

In the sixth embodiment, as shown in FIG. 8, cartridge 610 made of translucent ABS resin and having a box configuration with a height of 50 mm, a width of 40 mm and a depth of 15 mm, which is identical to the cartridge of the first embodiment, is used. However, the internal construction of this cartridge 610 is different from that of ink cartridge 110 in the first embodiment.

In this sixth embodiment, as shown in FIG. 8, no partitions are used inside cartridge 610, and instead, ink holding member 602 made of the same polyurethane sponge used in the first embodiment is housed in the entire interior of cartridge 610 while being compressed such that its density will become approximately 1.5 times its original density. Ribs 614 placed in the upper area inside cartridge 610 position ink holding member 602 and form air chamber 615 in the upper area of cartridge 610. Air inlet 616 to introduce air into cartridge 610 is formed in the top wall of this air chamber 615.

In ink cartridge 610 of this embodiment, ink supply outlet 617 having a 1.0 mm inner diameter is placed on its bottom in the same manner as with cartridge 110 of the first embodiment, such that the ink supply outlet protrudes downward. Further, also as in the first embodiment, protruding member 620 comprising a cylinder which has a 6.0 mm inner diameter and a height of 2.0 mm, and a part 621 of which is cut away such that the opening will measure 5.0 mm in width, is placed around ink supply outlet 617 such that it protrudes into cartridge 610.

Seventh Embodiment

Ink cartridge 710 of the seventh embodiment, as shown in FIG. 9, is made of translucent ABS resin, and has a box configuration with a height of 50 mm, a width of 40 mm and a depth of 15 mm, as in the first embodiment described above. Its internal construction, however, differs from that of cartridge 110 of the first embodiment.

Partition 711 that divides the interior of cartridge 710 into top and bottom parts is placed inside said cartridge. The part above partition 711 is used as ink storage chamber 712 in which ink 701 is stored, while the part below said partition is used as ink holding chamber 713 in which ink holding member 702 is housed. A part of partition 711 is cut away, and this opening comprises ink path opening 711*a* that links ink storage chamber 712 and ink holding chamber 713.

Ink holding member 702 is made of polyurethane sponge, as in the first embodiment, and is housed inside ink holding chamber 713 while being compressed such that its density will become approximately 1.5 times its original density. Ribs 714 are placed apart from ink path opening 711*a* in this ink holding chamber 713. These ribs 714 position ink holding member 702 in ink holding chamber 713. These ribs 714 also form air chamber 715 on the side of ink holding chamber 713. Air inlet 716 to introduce air into cartridge 710 is formed in the side wall of this air chamber 715.

At the bottom of ink holding chamber 713 is placed ink supply outlet 717 having a 1.0 mm inner diameter such that it protrudes downward, in the same manner as in the first embodiment. Further, protruding member 720 comprising a cylinder having a 6.0 mm inner diameter and a height of 2.0 mm, and a part 721 of which is cut away such that the opening will measure 5.0 mm in width, is placed around ink supply outlet 717 such that it protrudes into cartridge 710.

First Comparison Model

Ink cartridge 810 of the first comparison model is equivalent to ink cartridge 110 of the first embodiment without protruding member 120, as shown in FIG. 10. In FIG. 10, items 801, 802, 811, 811*a*, 812, 813, 814, 815, 816 and 817 correspond to items 101, 102, 111, 111*a*, 112, 113, 114, 115, 116 and 117, respectively, shown in FIG. 1.

Second Comparison Model

Figure 11:
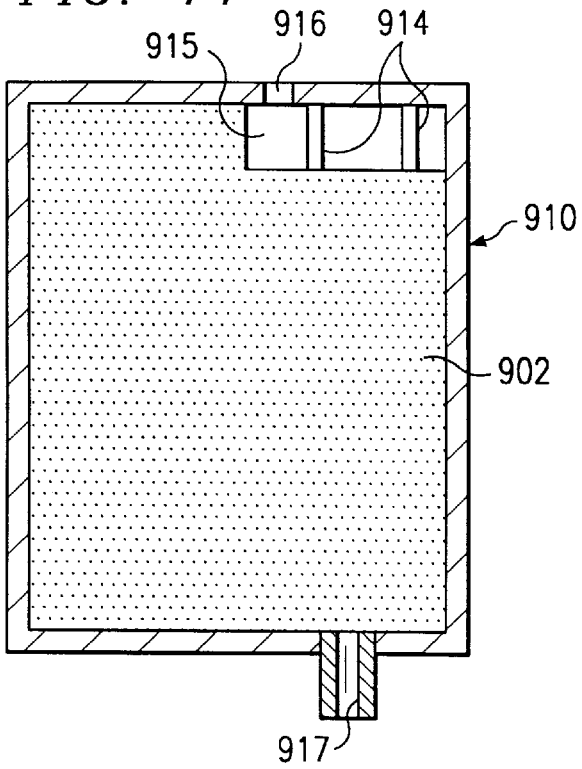
FIG. 11 is a cross-section of an ink cartridge of a second comparison model.

Ink cartridge 910 of the second comparison model is equivalent to ink cartridge 610 of the sixth embodiment without protruding member 620, as shown in FIG. 11. In FIG. 11, items 902, 914, 915, 916 and 917 correspond to items 602, 614, 615, 616 and 617, respectively, shown in FIG. 8.

Third Comparison Model

Figure 12:
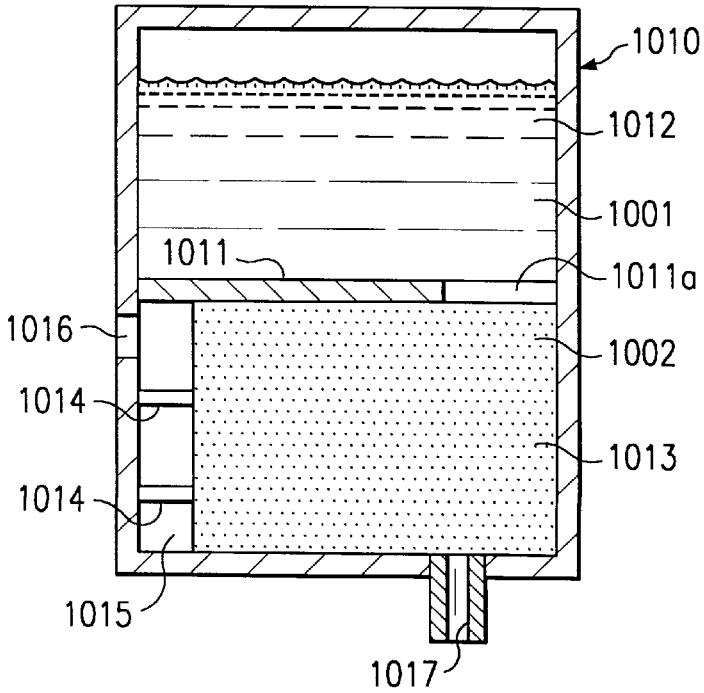
FIG. 12 is a cross-section of an ink cartridge of a third comparison model.

Ink cartridge 1010 of the third comparison model is equivalent to ink cartridge 710 of the seventh embodiment without protruding member 720, as shown in FIG. 12. In FIG. 12, items 1001, 1002, 1011, 1011*a*, 1012, 1013, 1014, 1015, 1016 and 1017, correspond to items 701, 702, 711, 711*a*, 712, 713, 714, 715, 716 and 717, respectively, shown in FIG. 9.

Comparative Experiments

A tube pump was connected to the ink supply outlet to perform aspiration, in order to investigate the ink expulsion performance shortly after ink was supplied to the ink holding member using the ink cartridges of the first through seventh embodiments, as well as the first through third comparison models described above. Further, aspiration was performed at a flow rate set within a range of 0.1 ml/min to 5.0 ml/min to measure the maximum amount of ink expelled from the ink cartridge without the inclusion of air bubbles. Table 1 shows the results of these experiments.

With regard to the ink expulsion performance shortly after ink was supplied to the ink holding member, cases in which the ink began to flow in a stable manner within three seconds or less were checked as ○, cases in which the ink began to flow in a stable manner within three to five seconds were checked as Δ, and cases in which it took five seconds or more for the ink to begin to flow were checked as X.

TABLE 1

| | Expulsion Performance Shortly After Ink Supply | Maximum Expulsion Amount (ml/min.) |
|---|---|---|
| First Embodiment | ○ | 5.0 |
| Second Embodiment | ○ | 5.0 |
| Third Embodiment | ○ | 4.0 |
| Fourth Embodiment | ○ | 4.5 |
| Fifth Embodiment | ○ | 5.0 |
| Sixth Embodiment | ○ | 5.0 |
| Seventh Embodiment | ○ | 5.0 |
| First Comparison Model | X | 2.0 |
| Second Comparison Model | X | 3.0 |
| Third Comparison Model | X | 2.0 |

As is clear from the table, in the ink cartridges of the first through seventh embodiments in which the protruding member pushes up the ink holding member at the area surrounding the ink supply outlet to create a space between the ink supply outlet and the ink holding member and to secure an ink pathway leading to the ink supply outlet, a sufficient amount of ink is smoothly supplied to the outside via the ink supply outlet immediately after the ink was supplied to the ink holding chamber in comparison with the ink cartridges of the first through third comparison models that did not have said protruding member.

As is clear from the explanation provided above, in the ink cartridges of the embodiments, because the protruding member protrudes into the cartridge from the area surrounding the ink supply outlet so as to push up the ink holding member, the ink holding member is compressed by means of this protruding member. This compression helps the ink held in the ink holding member to flow out easily from it. Further, since this protruding member is missing in at least a part of the area surrounding the ink supply outlet to secure an ink pathway, ink is sent smoothly to the ink supply outlet.

Consequently, when any of these ink cartridges is used, the ink held in the ink holding member is smoothly sent to the ink supply outlet, and even shortly after the ink is supplied to the ink holding member or when a large amount of ink is supplied to the print head via the ink supply outlet for purposes of continuous printing or purging, a sufficient amount of ink is supplied to the print head via the ink supply outlet in a stable fashion, and printing problems are prevented.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An ink cartridge for use in an inkjet printer, said ink cartridge comprising:

an ink holding chamber;

an ink holding member, which is placed inside the ink holding chamber, for holding ink;

an ink supply outlet that extends through a wall of the ink holding chamber and connects said ink holding chamber to an exterior thereof; and at least one protruding member that is placed on an interior surface of the wall of the ink holding chamber in which the ink supply outlet is formed and that protrudes into the ink holding chamber, said at least one protruding member being adjacent to but spaced apart from an opening of said ink supply outlet so that a portion of the wall of the ink holding chamber is disposed between said at least one protruding member and said opening of said ink supply outlet;

wherein said at least one protruding member presses onto said ink holding member so that a space is created between said opening of said ink supply outlet and said ink holding member.

2. An ink cartridge as claimed in claim 1, wherein said at least one protruding member is placed around said ink supply outlet.

3. An ink cartridge as claimed in claim 2, wherein said at least one protruding member comprises a hollow cylinder having a part of a side wall thereof cut away to form an ink path, a base of said cylinder being affixed to said wall of the ink holding chamber.

4. An ink cartridge as claimed in claim 2, wherein said at least one protruding member has a configuration of a U with three sides.

5. An ink cartridge as claimed in claim 2, wherein said at least one protruding member comprises a plurality of plates which are arranged around said ink supply outlet with gaps between each of said plates.

6. An ink cartridge as claimed in claim 2, wherein said at least one protruding member comprises a plurality of protrusions which are arranged around said ink supply outlet.

7. An ink cartridge as claimed in claim 6, wherein said plurality of protrusions are arranged around said ink supply outlet at equal intervals.

8. An ink cartridge as claimed in claim 6, wherein said plurality of protrusions are randomly arranged around said ink supply outlet.

9. An ink cartridge as claimed in claim 2, wherein said at least one protruding member substantially circumferentially surrounds said ink supply outlet.

10. An ink cartridge as claimed in claim 1, further comprising an ink storage chamber which is connected to said ink holding chamber through an ink path opening.

11. An ink cartridge as claimed in claim 10, wherein said ink storage chamber is positioned on a side of said ink holding chamber.

12. An ink cartridge as claimed in claim 10, wherein said ink storage chamber is positioned above said ink holding chamber.

13. An ink cartridge as claimed in claim 10, wherein said at least one protruding member comprises a hollow cylinder having a part of a side wall thereof cut away to form an ink path, a base of said cylinder being affixed to said wall of the ink holding chamber, said part of a side wall which is cut away facing substantially towards said ink path opening.

* * * * *